US009903118B2

(12) United States Patent
Ventling

(10) Patent No.: US 9,903,118 B2
(45) Date of Patent: Feb. 27, 2018

(54) TEMPORARY INTERLOCKING SPACER BAR FOR TRUSS-WALL INSTALLATION

(71) Applicant: Steve Ventling, Billings, MT (US)

(72) Inventor: Steve Ventling, Billings, MT (US)

(73) Assignee: TRUSSLOX LLC, Billings, MT (US)

( * ) Notice: Subject to any disclaimer, the term of this patent is extended or adjusted under 35 U.S.C. 154(b) by 87 days.

(21) Appl. No.: 15/080,387

(22) Filed: Mar. 24, 2016

(65) Prior Publication Data

US 2016/0258162 A1 Sep. 8, 2016

Related U.S. Application Data

(62) Division of application No. 14/210,737, filed on Mar. 14, 2014, now Pat. No. 9,297,174.

(Continued)

(51) Int. Cl.

| | |
|---|---|
| ***E04C 5/16*** | (2006.01) |
| ***E04C 3/02*** | (2006.01) |
| ***E04B 1/35*** | (2006.01) |
| ***E04B 1/26*** | (2006.01) |
| ***E04G 21/14*** | (2006.01) |

(Continued)

(52) U.S. Cl.

CPC ..... *E04C 5/16* (2013.01); *E04B 1/2608* (2013.01); *E04B 1/355* (2013.01); *E04B 2/56* (2013.01); *E04C 3/02* (2013.01); *E04C 3/11* (2013.01); *E04G 21/14* (2013.01); *E04B 1/26* (2013.01); *E04B 2001/2616* (2013.01);

(Continued)

(58) Field of Classification Search

CPC . E04B 2/56; E05D 11/00; E04G 21/14; E04G 21/16; E04G 21/165; E04G 21/1841; E04G 21/26; Y10T 16/554; B25B 3/00; B66F 15/00; E04C 2003/026; G01B 5/25; G01B 5/24; G01B 3/30

USPC ... 52/688, 745.11, 745.14, 745.15, 633, 690, 52/696, 693, 127.2, 749.12; 81/125.1; 269/3, 6, 95; 254/21, 19, 28; 33/613, 33/645

See application file for complete search history.

(56) References Cited

U.S. PATENT DOCUMENTS 37,865 A * 3/1863 Griswold ..... B25B 13/08 81/124.4
184,459 A * 11/1876 Coates ..... B23K 37/047 269/36

(Continued)

FOREIGN PATENT DOCUMENTS

GB 2029484 A * 3/1980 ..... E04G 21/1891

*Primary Examiner* — Joshua J Michener
*Assistant Examiner* — Keith Minter
(74) *Attorney, Agent, or Firm* — Husch Blackwell LLP

(57) ABSTRACT

A method for installing a truss-wall stud unit includes coupling a set of bottom plates with a foundation, coupling a set of hinge brackets with the set of bottom plates, coupling a first partial truss with a second partial truss to form a truss-wall stud unit, coupling the truss-wall stud unit with the bottom plates and hinge brackets, and hoisting the truss-wall stud unit into a substantially vertical position. A system includes truss-wall stud units which are connected to bottom plates using hinge brackets. Once connected to the hinge brackets and bottom plates, the truss-wall stud units are hoisted upright into a substantially vertical position using a cable system with a cable support system. Temporary interlocking spacer bars are used to brace the truss-wall stud units at predetermined intervals.

9 Claims, 18 Drawing Sheets

Related U.S. Application Data

(60) Provisional application No. 61/781,765, filed on Mar. 14, 2013.

(51) Int. Cl.
*E04B 2/56* (2006.01)
*E04C 3/11* (2006.01)

(52) U.S. Cl.
CPC . *E04B 2001/2684* (2013.01); *E04C 2003/026* (2013.01); *Y10T 16/554* (2015.01)

(56) References Cited

U.S. PATENT DOCUMENTS 235,877 A * 12/1880 Jones ..... B66F 15/00 254/130
305,776 A * 9/1884 Amstutz ..... B23K 37/047 269/303
328,655 A * 10/1885 Corning et al. ..... B25C 11/00 254/21
499,863 A * 6/1893 Walker et al. ..... B25B 13/48 81/124.2
815,064 A * 3/1906 Campbell ..... B66F 15/00 254/131
1,488,726 A * 4/1924 Alexander ..... E04B 1/4185 249/219.1
1,546,721 A * 7/1925 Davis ..... B25B 5/08 269/104
1,597,785 A * 8/1926 Jones ..... B25B 13/06 81/124.3
2,300,840 A * 11/1942 Huxel ..... B25F 1/00 254/21
2,567,586 A * 9/1951 Werder ..... E04G 21/1891 269/40
2,812,077 A 11/1957 Proctor
2,846,760 A * 8/1958 Rohn ..... E04C 3/02 428/573
3,137,922 A * 6/1964 Schumacher ..... B21D 5/08 29/897.32
3,201,874 A * 8/1965 Christy ..... E04C 3/02 269/43
3,485,386 A 12/1969 Miller
3,662,502 A 5/1972 Wright
3,778,952 A * 12/1973 Soucy ..... E04B 2/763 403/253
3,785,108 A 1/1974 Satchell
3,984,079 A * 10/1976 Gates ..... E04G 17/0742 249/190
4,003,179 A * 1/1977 Gilb ..... E04B 1/2608 403/217
4,005,556 A 2/1977 Tuomi
4,023,323 A * 5/1977 Fortin ..... E04B 1/7666 52/404.2
4,170,852 A 10/1979 Danis, Jr.
4,246,736 A * 1/1981 Kovar ..... E04C 3/02 52/696
4,253,649 A * 3/1981 Hewson ..... B25B 1/22 269/45
4,294,050 A 10/1981 Kandel
4,322,064 A * 3/1982 Jarvis ..... B25B 11/02 269/237
4,490,956 A * 1/1985 Palacio ..... E04C 3/02 411/466
4,625,415 A * 12/1986 Diamontis ..... B25B 11/02 33/562
4,662,146 A 5/1987 Parry
4,704,829 A * 11/1987 Baumker, Jr. ..... E04B 7/022 269/43
D293,416 S * 12/1987 Krueger ..... 52/696
4,718,564 A 1/1988 Bailey
4,802,389 A * 2/1989 Shultz ..... B25B 13/14 81/127
4,831,807 A 5/1989 Bolt
4,958,814 A * 9/1990 Johnson ..... E04G 21/1891 248/216.1
D318,785 S * 8/1991 Dean ..... 52/696
5,148,890 A * 9/1992 Sipe ..... E04G 3/26 182/222
D332,950 S * 2/1993 Kirwan ..... D14/432
D333,421 S * 2/1993 Patti ..... D12/406
D340,856 S * 11/1993 McHugh ..... D8/354
5,412,920 A * 5/1995 Hess ..... E04B 5/12 403/232.1
D359,944 S * 7/1995 Roberts ..... D12/415
5,490,334 A * 2/1996 Payne ..... E04G 21/1891 269/904
5,606,837 A * 3/1997 Holizlander ..... E04C 3/02 52/639
5,628,119 A * 5/1997 Bingham ..... E04G 21/1891 269/904
5,785,305 A * 7/1998 Stalker ..... B25B 5/142 269/228
5,833,430 A 11/1998 Reynolds et al.
5,884,411 A * 3/1999 Raber ..... E04G 21/18 269/904
5,884,448 A * 3/1999 Pellock ..... E04B 7/022 52/643
5,943,830 A 8/1999 Truitt
D415,597 S * 10/1999 Neff ..... D32/46
5,983,577 A 11/1999 Hays
6,000,898 A 12/1999 Sharp
6,108,923 A * 8/2000 Polkhovskiy ..... G01B 3/30 33/501.45
6,244,010 B1 * 6/2001 Sluiter ..... E04B 7/022 52/639
6,296,230 B1 * 10/2001 Roth ..... B66F 15/00 254/131
6,334,287 B1 1/2002 Fick
6,354,055 B1 * 3/2002 Shaw ..... E04B 7/022 52/696
6,385,859 B1 * 5/2002 Varney ..... E04F 21/1838 269/43
6,393,794 B1 * 5/2002 Pellock ..... E04B 7/024 52/203
6,418,695 B1 * 7/2002 Daudet ..... E04B 7/022 52/639
D463,575 S * 9/2002 Daudet ..... D25/61
6,598,857 B1 * 7/2003 Hernandez ..... B66F 15/00 254/21
6,877,291 B2 * 4/2005 Shamroukh ..... E04B 7/022 403/232.1
6,899,310 B1 * 5/2005 Trangsrud ..... E04C 5/167 248/316.7
7,367,545 B1 * 5/2008 Chen ..... B25C 11/00 254/21
7,377,048 B2 * 5/2008 Koetter ..... E04B 7/022 269/37
D587,099 S * 2/2009 Brizendine ..... D8/354
7,571,551 B1 * 8/2009 Anderson ..... E04G 21/1841 33/613
7,690,128 B1 * 4/2010 Thompson ..... G01B 5/255 33/533
7,690,627 B2 * 4/2010 Harpell ..... B25C 11/00 254/131
7,765,755 B2 8/2010 Williams
7,823,347 B1 * 11/2010 Blinn ..... B66C 23/62 182/186.7
8,317,454 B1 11/2012 Parker
8,393,126 B1 * 3/2013 Watson ..... E04C 3/06 52/643
8,443,568 B2 * 5/2013 Lin ..... E04B 7/063 52/655.1
8,601,705 B2 * 12/2013 Bierman ..... G01B 3/30 33/613
D702,533 S * 4/2014 Noturno ..... D8/354
8,683,772 B2 * 4/2014 Friis ..... E04B 7/022 52/691

(56) References Cited

U.S. PATENT DOCUMENTS 8,955,827 B2 * 2/2015 Brown ..... B25C 11/00 254/21
D730,759 S * 6/2015 Federspiel ..... D10/64
9,085,888 B2 * 7/2015 Fuller ..... E04B 7/024
9,297,174 B2 * 3/2016 Ventling ..... E04G 21/14
9,404,257 B2 * 8/2016 Reno ..... E04C 3/02
2002/0092259 A1 * 7/2002 Crawford ..... E04B 7/022 52/696
2006/0010703 A1 * 1/2006 Gauthier ..... E04G 21/1891 33/613
2006/0192067 A1 * 8/2006 Oh ..... A62C 35/68 248/342
2006/0196068 A1 * 9/2006 Thompson ..... E04G 21/1891 33/613
2006/0253057 A1 * 11/2006 Qi ..... E04C 3/04 602/23
2006/0260219 A1 * 11/2006 Riddle ..... E04G 21/1891 52/127.2
2006/0260239 A1 * 11/2006 Boese ..... E04G 17/14 52/426
2007/0012847 A1 * 1/2007 Tai ..... E04B 9/006 248/343
2007/0277463 A1 * 12/2007 Heirich ..... B21D 5/08 52/309.16
2009/0100694 A1 * 4/2009 Hooks ..... E04G 21/1891 33/645
2009/0139183 A1 * 6/2009 Brizendine ..... E04D 15/00 52/749.12
2009/0151294 A1 * 6/2009 Staley ..... E04B 7/063 52/655.1
2010/0064615 A1 * 3/2010 Boese ..... E04B 1/16 52/426
2010/0251660 A1 * 10/2010 McCann ..... E04C 3/17 52/677
2011/0154768 A1 6/2011 Kralic et al.
2011/0308184 A1 12/2011 Ryan
2012/0180422 A1 * 7/2012 Noturno ..... E04G 21/1891 52/696
2013/0263382 A1 * 10/2013 Sindt ..... B25C 11/00 7/166
2014/0311082 A1 * 10/2014 Sidhu ..... F16B 9/00 52/693
2015/0076425 A1 * 3/2015 Lasaga ..... B25C 11/00 254/21
2015/0345133 A1 * 12/2015 Sidhu ..... E04B 5/12 52/167.1
2016/0121478 A1 * 5/2016 Schein ..... B25H 3/06 206/350
2016/0168841 A1 * 6/2016 Zhou ..... E04H 12/085 52/652.1

* cited by examiner

TEMPORARY INTERLOCKING SPACER BAR FOR TRUSS-WALL INSTALLATION

CROSS-REFERENCE TO RELATED APPLICATIONS

This Application is a Divisional of and claims priority to U.S. patent application Ser. No. 14/210,737, filed Mar. 14, 2014 to Steve Ventling, entitled "Truss-Wall Installation System and Related Methods," currently pending. This Application further claims the benefit of U.S. Provisional Patent Application Ser. No. 61/781,765 filed Mar. 14, 2013, to Steve Ventling entitled "Truss-Wall Installation System and Related Methods."The entire disclosures, including the specifications and drawings, of all above-referenced applications are incorporated herein by reference.

TECHNICAL BACKGROUND

Conventional wood framing typically involves pre-building walls on a cement or wood subfloor and then manually lifting the walls up and securing with bracing, nails, and/or anchor bolts attached to a concrete slab. Depending on the size of the building, the pre-built walls may need to be lifted and set into place in sections. Once the walls are lifted and set into place on the bottom plate, it is securely braced from numerous angles to ensure it does not collapse or fall due to winds. Without the assistance of heavy equipment, such as a forklift or a crane, the process of lifting and setting pre-built walls is dangerous due to the weight and instability of the walls.

Once the walls are set and braced, heavy equipment, such as a crane, is used to set trusses on top of the walls. The truss is lifted over the walls and maneuvered into place, requiring many workers. The process can be a dangerous, time consuming, and expensive process.

SUMMARY

The system includes truss-wall stud units, which are connected to bottom plates on a foundation using hinge brackets. Once connected to the hinge brackets and bottom plates, the truss-wall stud units are hoisted upright into a substantially vertical position using a cable hoisting system with a cable support system. An end wall unit is braced, for example, with a telescoping bracing bar attached to a stationary object, for example, a pickup truck. Temporary interlocking spacer bars are optionally used to separate and brace the upper truss members of the truss-wall stud unit at predetermined intervals, for example 24" intervals.

In one or more embodiments, a method for installing a truss-wall stud includes coupling a set of bottom plates with a foundation, coupling a set of hinge brackets with the set of bottom plates, coupling a first partial truss-wall stud with a second partial truss-wall stud to form a truss-wall stud unit, coupling the truss-wall stud unit with the bottom plates and hinge brackets, and hoisting the truss-wall stud unit into a substantially vertical position with use of a cable hoisting system, cable support system, and temporary interlocking spacer bar.

BRIEF DESCRIPTION OF THE FIGURES

Embodiments of the invention are disclosed with reference to the accompanying drawings and are for illustrative purposes only. The invention is not limited in its application to the details of construction or the arrangements of components illustrated in the drawings. The invention is capable of other embodiments or of being practiced or carried out in various other ways. Like reference numerals are used to indicate like components. In the drawings.

DETAILED DESCRIPTION OF THE EMBODIMENTS

The following detailed description includes references to the accompanying drawings, which form a part of the detailed description. The drawings show, by way of illustration, specific embodiments in which the invention may be practiced. These embodiments are also referred to herein as "examples." The drawings and following detailed description is not to be taken in a limiting sense, and the scope of the present invention is defined by the appended claims and their equivalents.

A truss installation system and related components and methods are described herein. The truss installation system includes truss-wall stud units that are connected to a bottom plate using novel hinge brackets that are affixed to the bottom plate. Once connected to the hinge brackets and bottom plate, the truss-wall stud units are hoisted upright into place using unique cable hoisting and support systems designed to pull a cable through part of the truss-wall stud unit, where the cable hoisting system hoists the truss-wall stud unit, and the cable support system supports the unit as it is being hoisted. The system further includes a temporary interlocking spacer bar which is affixed to a top of the unit prior to hoisting of the unit, and assists in bracing the unit at predetermined positions.

Figure 6:
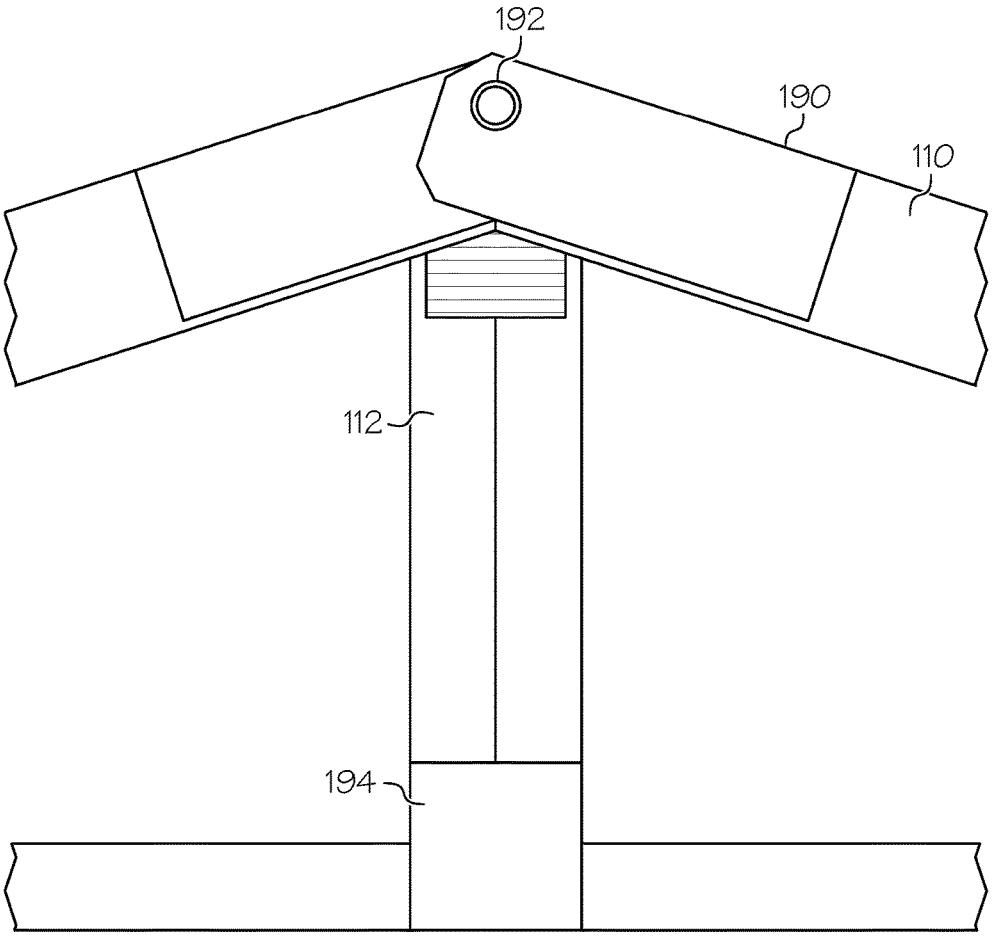
FIG. 6 illustrates a side elevation view of a portion of a truss-wall stud unit and folding beak peak bracket of a truss-wall stud installation system in accordance with one or more embodiments.
Figure 6A:
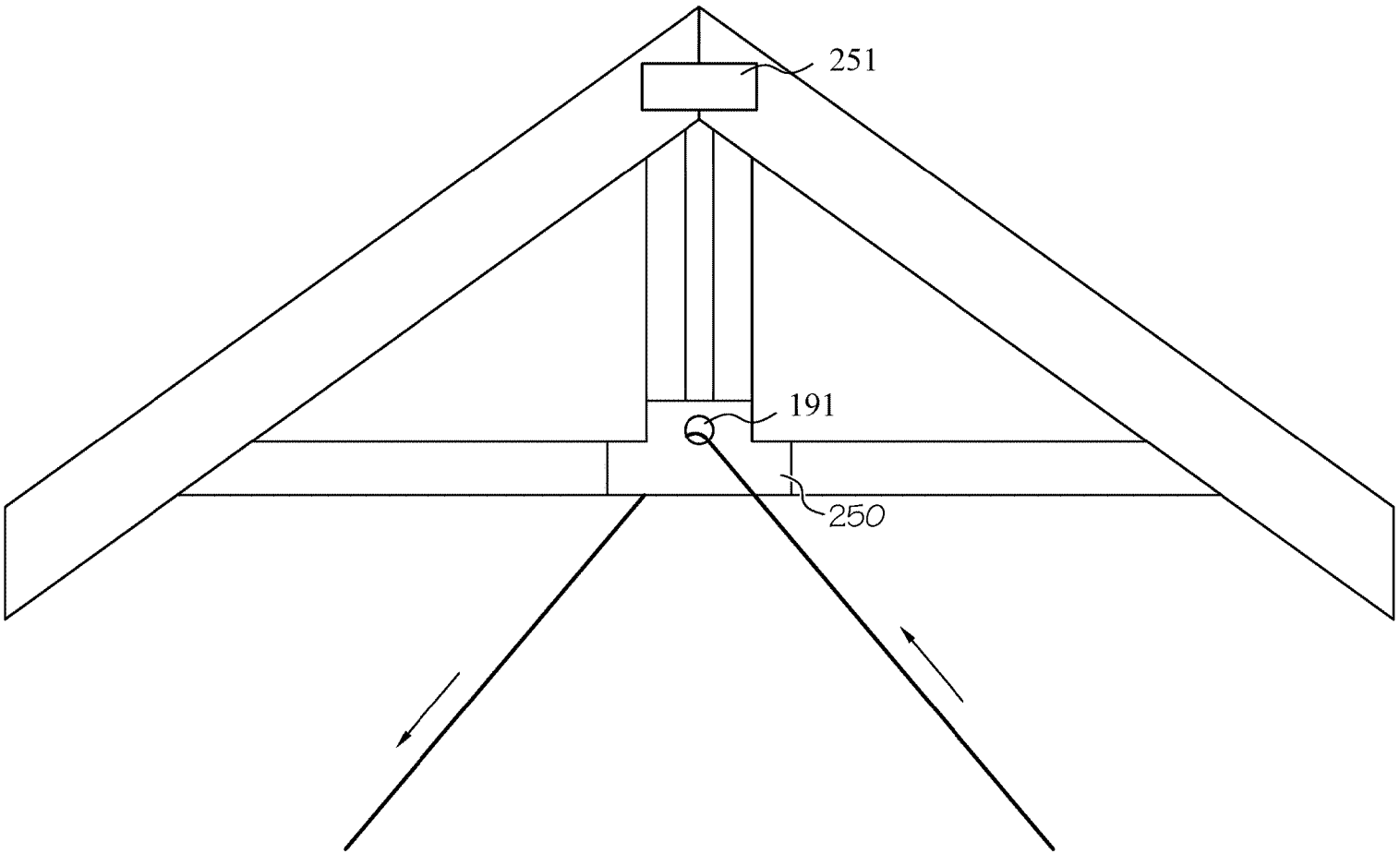
FIG. 6A illustrates a front view of a portion of a truss-wall stud unit, standard gusset plate, and bottom-chord splice bracket of a truss-wall stud installation system in accordance with one or more embodiments.
Figure 7:
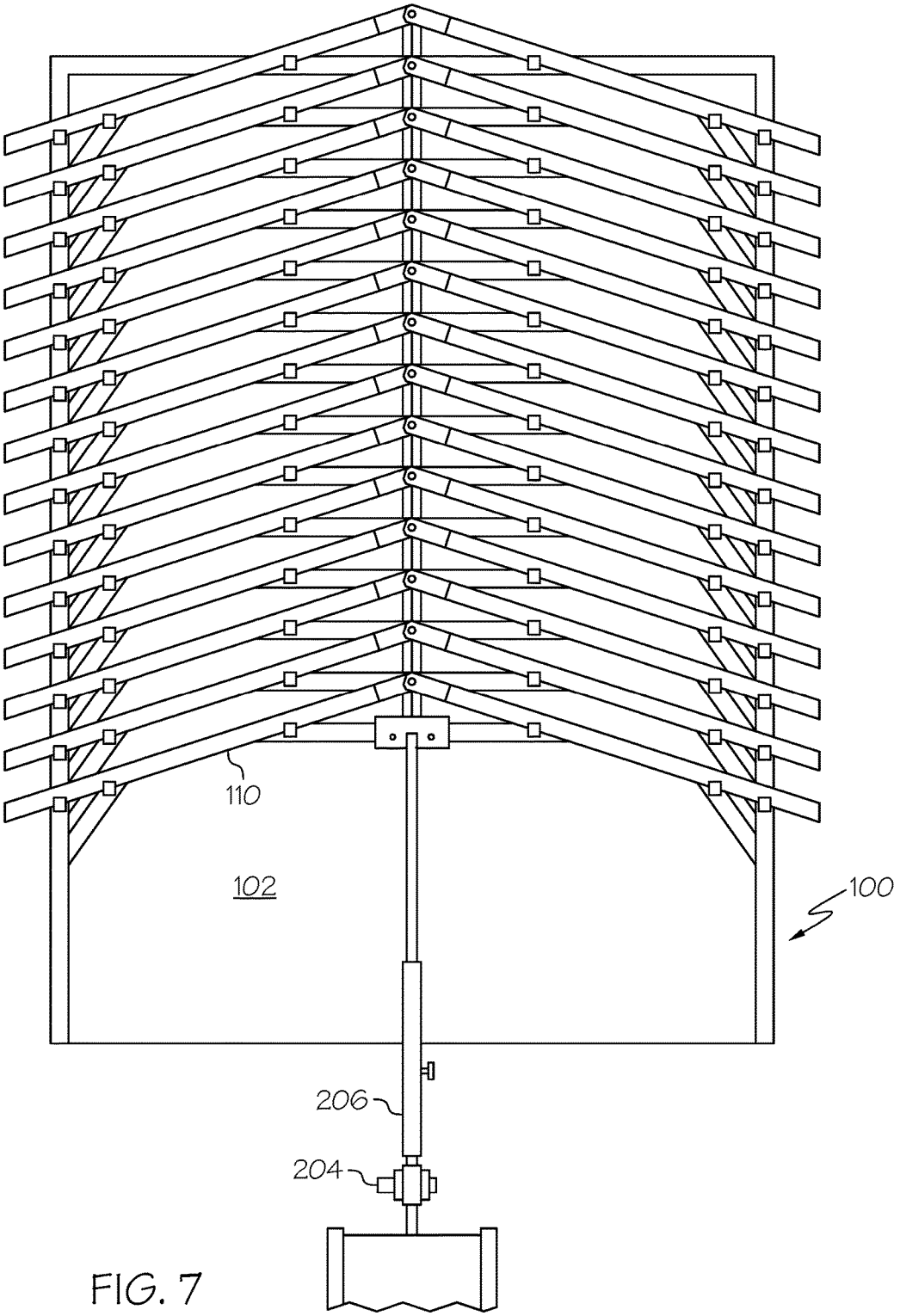
FIG. 7 illustrates a top plan view of a portion of a truss-wall stud installation system in accordance with one or more embodiments.
Figure 8:
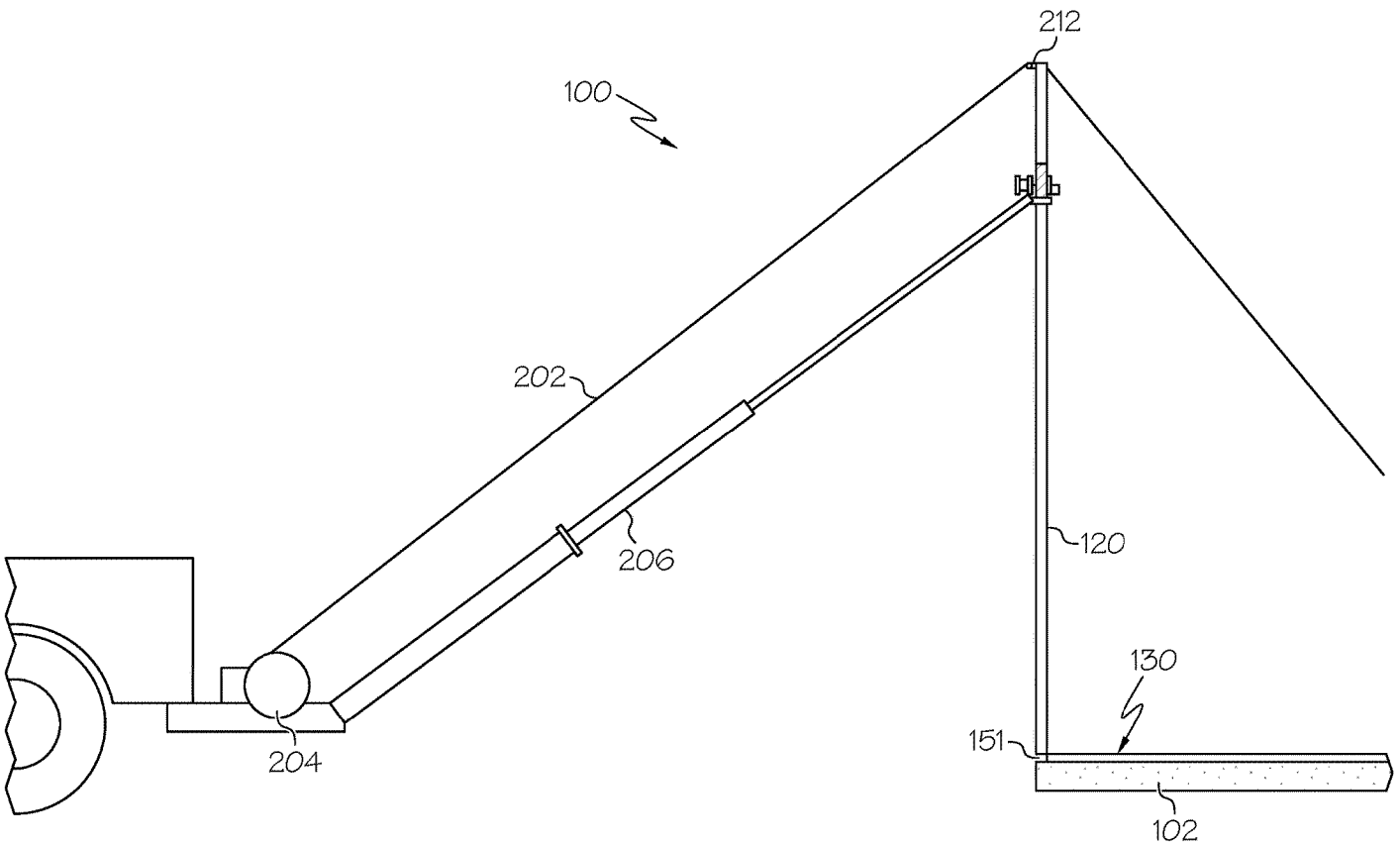
FIG. 8 illustrates a side view of the cable system, the telescoping bracing bar, and the end truss-wall stud unit of the truss-wall stud installation system in accordance with one or more embodiments.
Figure 9:
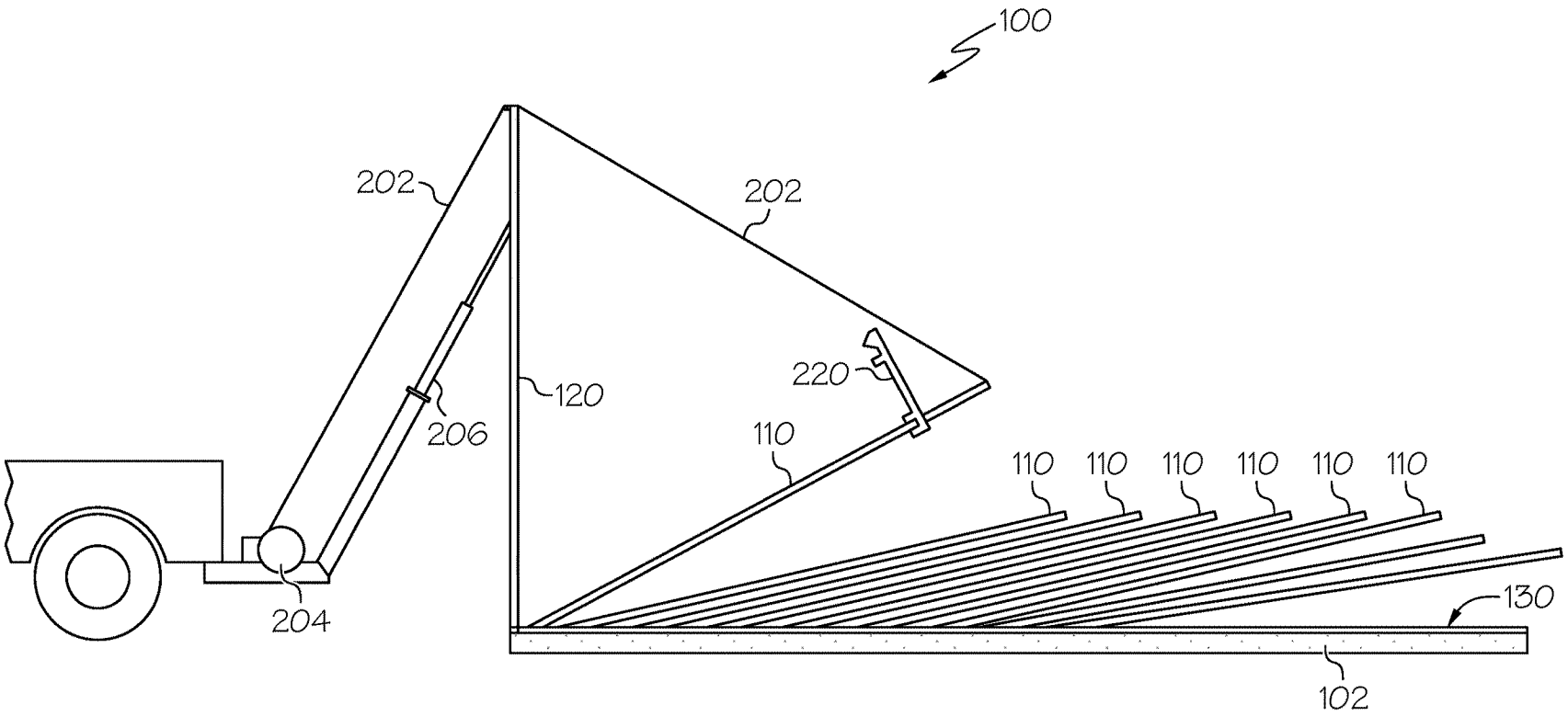
FIG. 9 illustrates a side view of the cable system, the telescoping bracing bar, and the truss-wall stud unit(s) of the truss-wall stud installation system in accordance with one or more embodiments.

Referring to FIGS. 1-16, the system 100 is used with a foundation 102, and includes a truss-wall stud unit 110. The truss-wall stud unit 110 is formed of two or more partial truss-wall stud units 118, and can further include an end truss-wall stud unit 120. The truss-wall stud units are formed of a series of web units 112 that are coupled together to form the truss-wall stud unit. The truss-wall stud units 110 can have a variety of shapes. For example, the truss-wall stud units can have an outer wall, central support, truss support, or a roof line. The truss-wall stud units can be pre-assembled at a factory, for example, prior to delivery at a construction site. The partial truss-wall stud units 118 can be fastened together at the job site, for example, using a folding peak bracket 190 as shown in FIG. 6 along the top portion of the truss-wall stud unit, and a lower connection plate 194 along the lower portion of the truss-wall stud unit 118. The folding peak bracket 190 includes a passage 192 therethrough for the cable system. In one or more embodiments, the passage 192 may be located in another location other than in the folding peak bracket 190. For example, the cable may be routed through another location or another part, such as, but not limited to, a location lower on the truss. Alternatively, the partial truss-wall stud units 118, can be fastened together at the job site, for example, using a standard gusset plate 251 and a bottom chord splice plate 250 as shown in FIG. 6A.

The foundation 102 can include a cement slab, cement footings, or traditionally used building foundations with treated timber bottom plates affixed therein with anchor bolts. The bottom plates 130 are used in conjunction with bottom hinge brackets 150, 151 (FIGS. 2-4, 8) to support the truss-wall stud units 110. The bottom plates 130 are assembled to the foundation 102 with anchor bolts.

The hinge brackets 150 are installed on the foundation offset from the anchor bolts. For example, the anchor bolts can be installed at odd intervals, and the hinge brackets 150 at even intervals and the end hinge brackets 151 are installed at the outer portions of the foundation 102.

Figure 1:
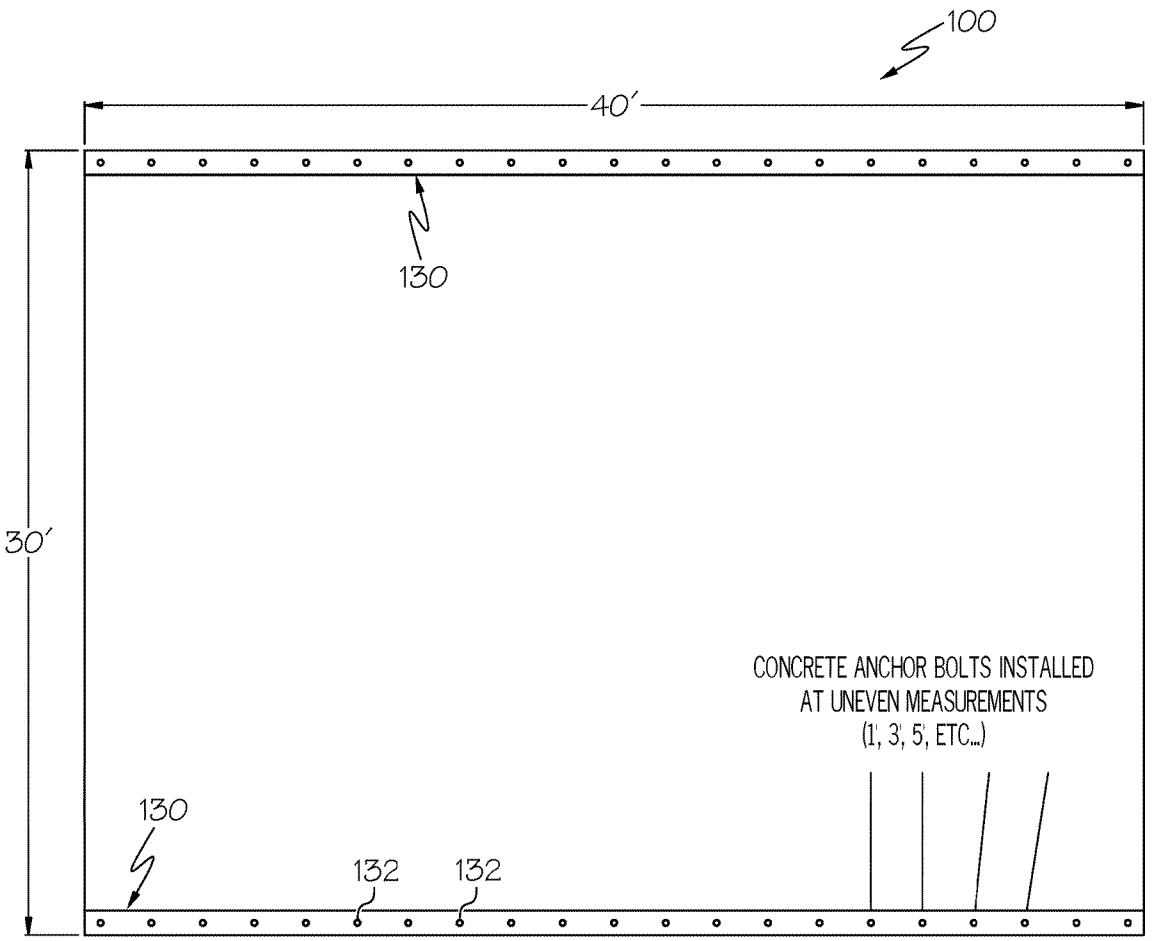
FIG. 1 illustrates a top plan view of a portion of a truss-wall stud installation system at a job site in accordance with one or more embodiments.
Figure 2:
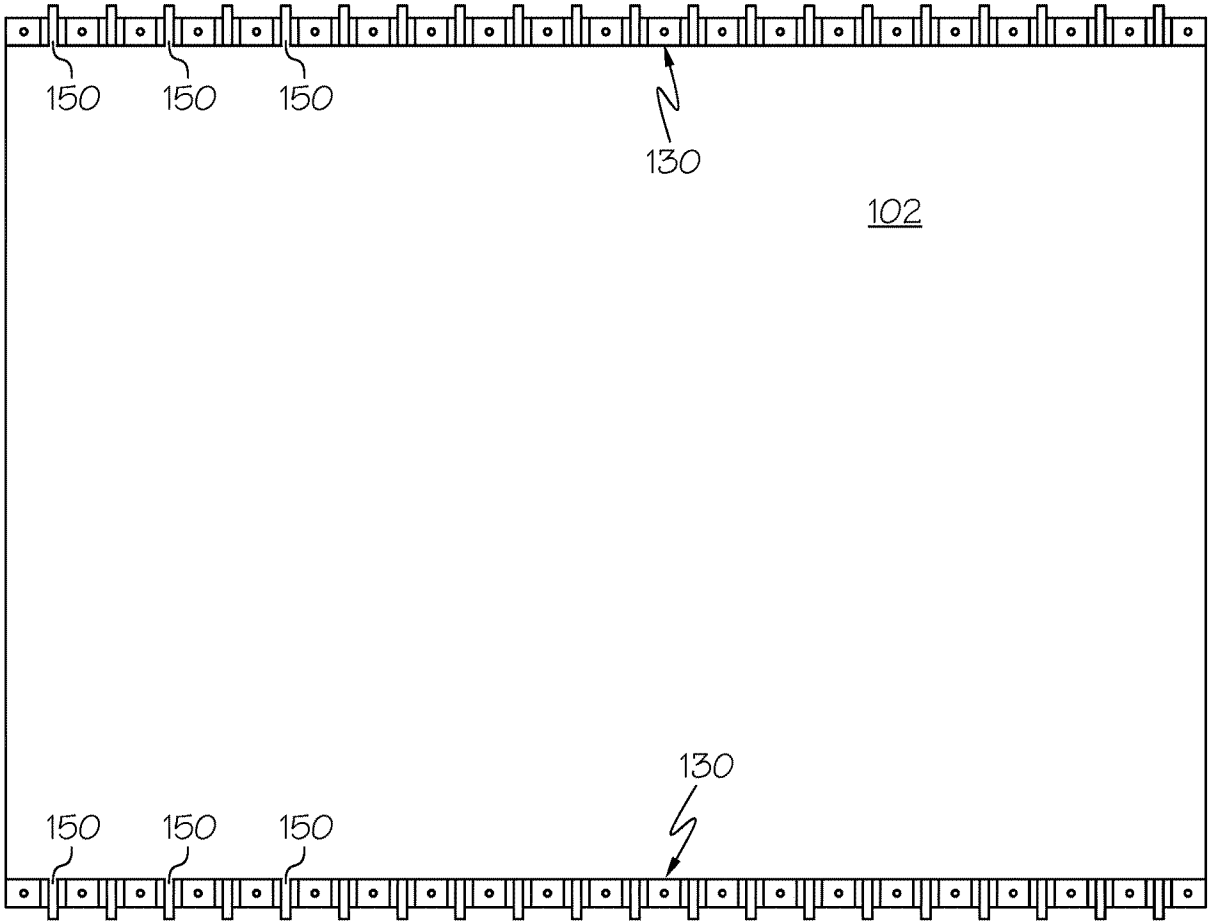
FIG. 2 illustrates a top plan view perspective view of a portion of a truss-wall stud installation system in accordance with one or more embodiments.
Figure 3:
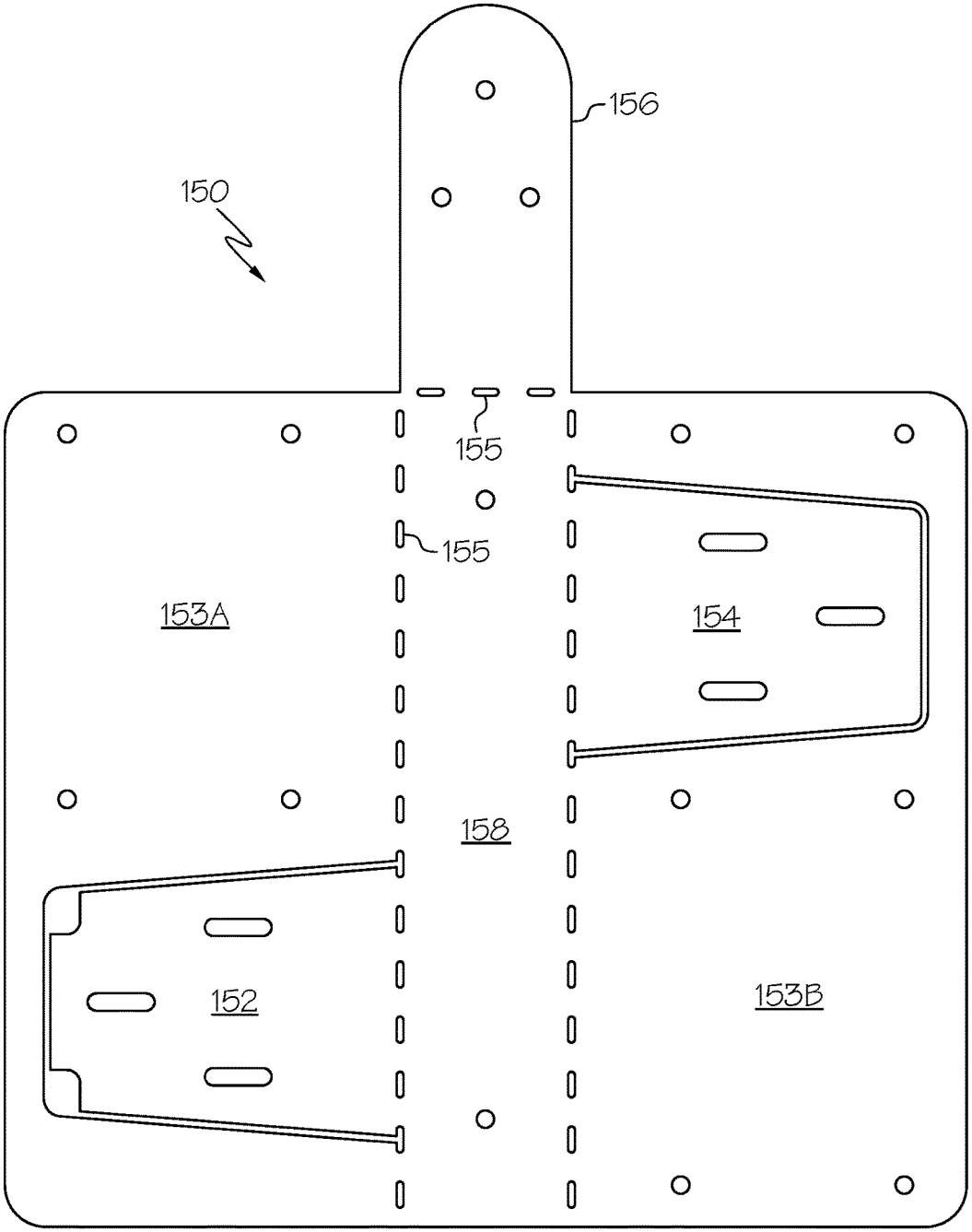
FIG. 3 illustrates a top plan view of a hinge bracket of a truss-wall stud installation system in accordance with one or more embodiments.

The hinge bracket 150, as shown in FIG. 3, includes two main portions 153A and 153B, a first inner portion 152, a second inner portion 154, within the main portions 153A and 153B, and an outside tab 156. The first inner portion 152 and the second inner portion 154 are disposed at least partially within the main portions 153A and 153B and are foldable relative to the main portions 153A and 153B. The hinge bracket 150 further includes an intermediate portion 158 disposed between the first inner portion 152 and the second inner portion 154, and the first and second inner portions 152, 154 are hingedly coupled relative to the intermediate portion 158 along a fold line 155. The hinge bracket 150 includes a number of nailing holes allowing for the hinge bracket 150 to be secured to the bottom plate. The fastener holes on the brackets, in one or more embodiments, are elongate in order to position and center the bracket for installation, and to account for inconsistencies in the concrete slab or foundation.

The first inner portion 152 and the second inner portion 154 are adapted to be folded up along fold lines 155 (i.e. slotted holes) and attached to a truss-wall stud unit leg. The outside tab 156 is further configured to be folded up along a fold line 155 (i.e. slotted holes) and attached to the truss-wall stud unit leg. The first inner portion 152 is opposite the second inner portion 154 with the intermediate portion 158 therebetween. After the first main portion 153A is affixed to the bottom plate, the first inner portion 152 and the intermediate portion 158 are assembled to the truss-wall stud unit leg prior to lifting into vertical position, and the second inner portion 154 is assembled to the truss-wall stud unit leg after the truss-wall stud unit is lifted toward the vertical position.

Figure 4:
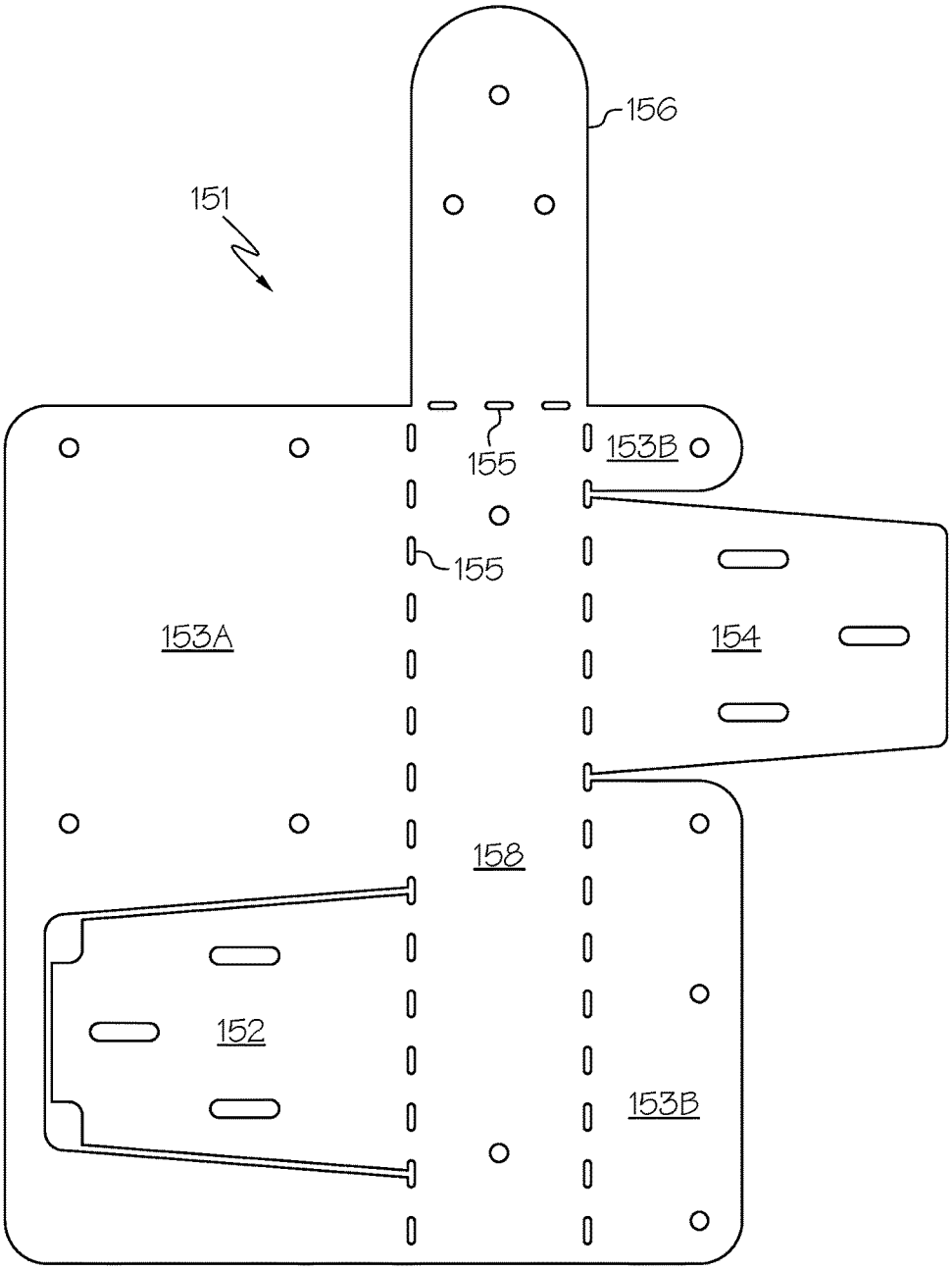
FIG. 4 illustrates a top plan view of an end hinge bracket of a truss-wall stud installation system in accordance with one or more embodiments.
Figure 5:
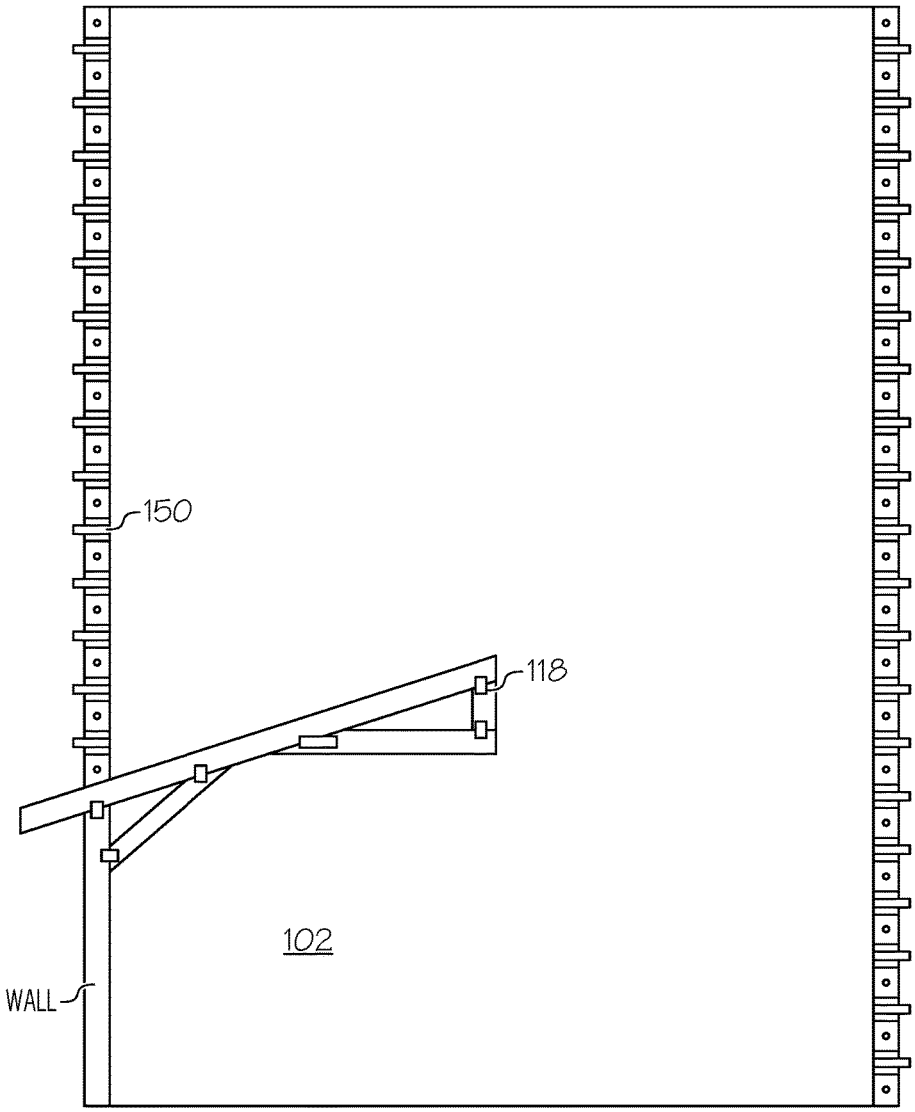
FIG. 5 illustrates a top plan view of a portion of a truss-wall stud installation system in accordance with one or more embodiments.

FIG. 4 illustrates an end hinge bracket 151 which differs from the hinge bracket 150 in that the second main portion 153B attaches to the bottom plate by folding down vertically along the end of the bottom plate. The first inner portion 152, second inner portion 154, and outside tab 156 are foldable like a hinge relative to the main portions 153A and 153B.

Referring to FIGS. 11A and 11B, 11C and 11D, the system 100 includes temporary interlocking spacer bar 220, where the figures illustrate variations for the spacer bar 220. The temporary interlocking spacer bar 220 includes a first side 254 and a second side 256, with the second side being opposite the first side 254. The temporary interlocking spacer bar 220 includes an elongate member 222 extending from a first end portion 224 to a second end portion 226 and having an intermediate portion 228 therebetween. The first end portion 224 and the second end portion 226 of the temporary interlocking spacer bar 220 have a retention member 230, where the retention member 230 is sized to receive and retain a truss member therein. In an example, the retention member 230 includes a U-shaped member 236. The first and second end portions 224 and 226 are sized to space two or more truss member studs. In an embodiment, the temporary interlocking spacer bar 220 includes an outer curved portion 232 opposite the retention member 230, allowing for the temporary interlocking spacer bar 220 to ride over a portion of an adjacent truss-wall stud unit before it slips securely into place during the hoisting ok the truss-wall stud unit.

In one or more embodiments, the temporary interlocking spacer bar 220 is plastic, metal, or similar material. In another embodiment, the temporary interlocking spacer bar 220 further includes rib supports 234 disposed near one or more end portions 224 and 226.

Referring to FIGS. 7-10, 12, 12A, 12B, 14, and 16, the system 100 further includes a cable system including a cable 202, a winch 204, a telescoping bracing bar 206, a pulley 212, and weights. The cable system is used to hoist, stabilize, and support the truss-wall stud unit 110 into the vertical position as further described below.

Figure 12:
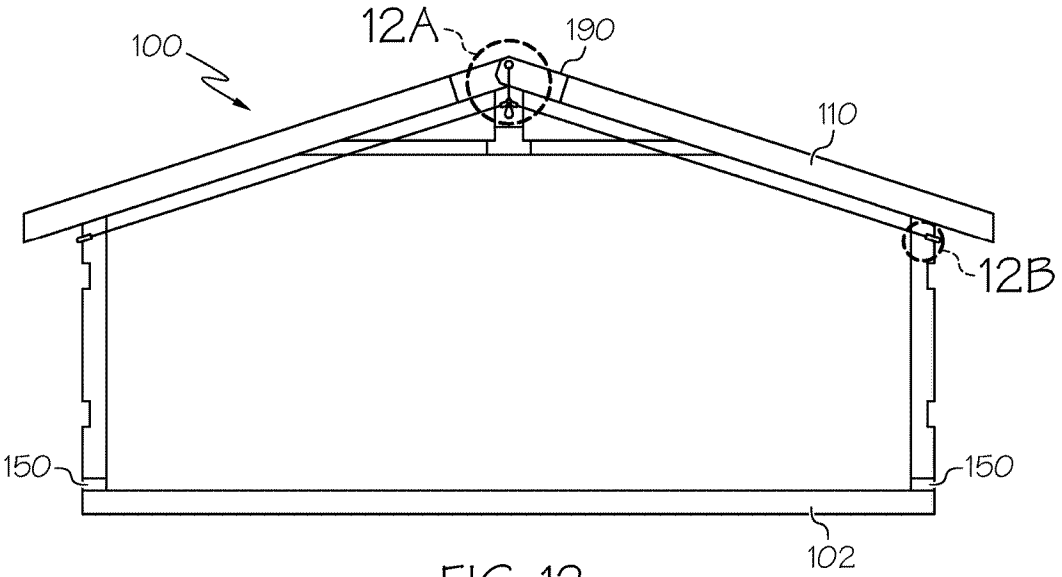
FIG. 12 illustrates an end view of a portion of a truss-wall stud installation system in accordance with one or more embodiments.

Referring generally to FIGS. 1-16, a method of use of the system 100 is as follows. For ease of shipping and handling, in an option, truss-wall stud units 110 are shipped to a job site, for example in halves. Each half includes a stud leg, which is affixed to half of a roof truss with truss fasteners, such as gang nails. In one or more embodiments, engineered webbing under a peak of the truss is split in half at the bottom chord for shipping. Optional notches are cut into each stud leg at intervals for placement of the lateral bracing, as shown in FIG. 12. A top notch is cut into the peak of each partial truss-wall stud 118 for placement of the folding peak bracket, including a passage, such as a grommet, for a lifting cable to pass therethrough. Alternatively, adjoining portions such as halves have a small gap when joined, allowing the cable grommet to be attached to brackets or plates that allow the lifting cable to pass therethrough.

Anchor bolts are used to set bottom plates at a foundation, such as, but not limited to, a cement slab. The anchor bolts are set at intervals, for example, at odd measured intervals. Hinge brackets are affixed to the bottom plates, for example, by fastening to a portion of the bottom bracket. The hinge brackets are set offset from the anchor bolts, for example, at even measured intervals, preventing interference between the anchor bolts and the hinge brackets.

To set the first end wall 120, partial truss-wall stud units, such as two halves are placed on the foundation with the peak tips together and the ends of each stud resting on top of the end wall bottom brackets. The folding peak brackets 190 are then positioned on the peak halves and fastened from the top side. Alternatively, a bottom-chord splice bracket 250 may be used. The bottom side is fastened during the hoisting process. The partial truss-wall stud units are connected together to form an end wall truss-wall stud unit.

After affixing the first main portion 153A of the end-wall hinge bracket to the bottom plate, the stud ends of the end wall truss-wall stud unit 120 are fastened to the end-wall hinge bracket 151 by bending the intermediate portion 158 and the second inner portion 154 of the end-wall hinge bracket 151 up over the stud of the truss-wall stud unit, and fastened thereto. The end wall is hoisted, and the second main portion 153B of the end-wall hinge bracket is affixed vertically to the bottom plate end. The truss-wall stud unit is set to plumb and securely braced so that the subsequent truss-wall stud units can be correctly set.

In order the hoist the end wall, the cable system, which includes a winch 204, is used. The winch 204, for example, mounted to a receiver hitch on a vehicle, is moved to a location near the end wall, for example approximately five to ten feet from the end wall. Cable 202 is released from the winch to pass the cable through the passage 192 in the peak of the truss-wall stud unit as it is lying on the ground, or alternatively through the passage 250 mounted on the bottom-chord of the truss-wall stud unit. Once the cable is passed through the passage 192 of the bracket 190, or alternatively 250, the pulley 212 is installed in the grommet of the passage under the cable in order to allow free movement of the cable as subsequent truss-wall stud units 110 are hoisted into place.

Figure 12B:
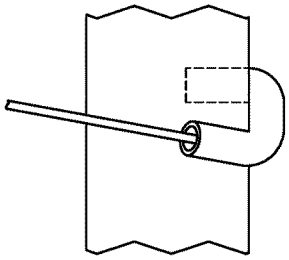
FIG. 12B is a partial view of the end view of a portion of a truss-wall stud installation system of FIG. 12.
Figure 12A:
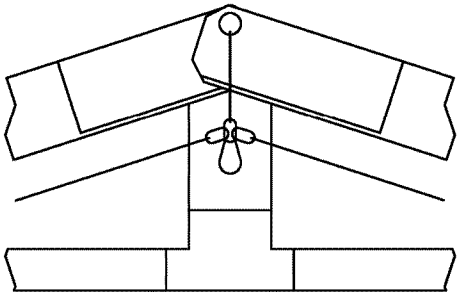
FIG. 12A is a partial view of the end view of a portion of a truss-wall stud installation system of FIG. 12.
Figure 13:
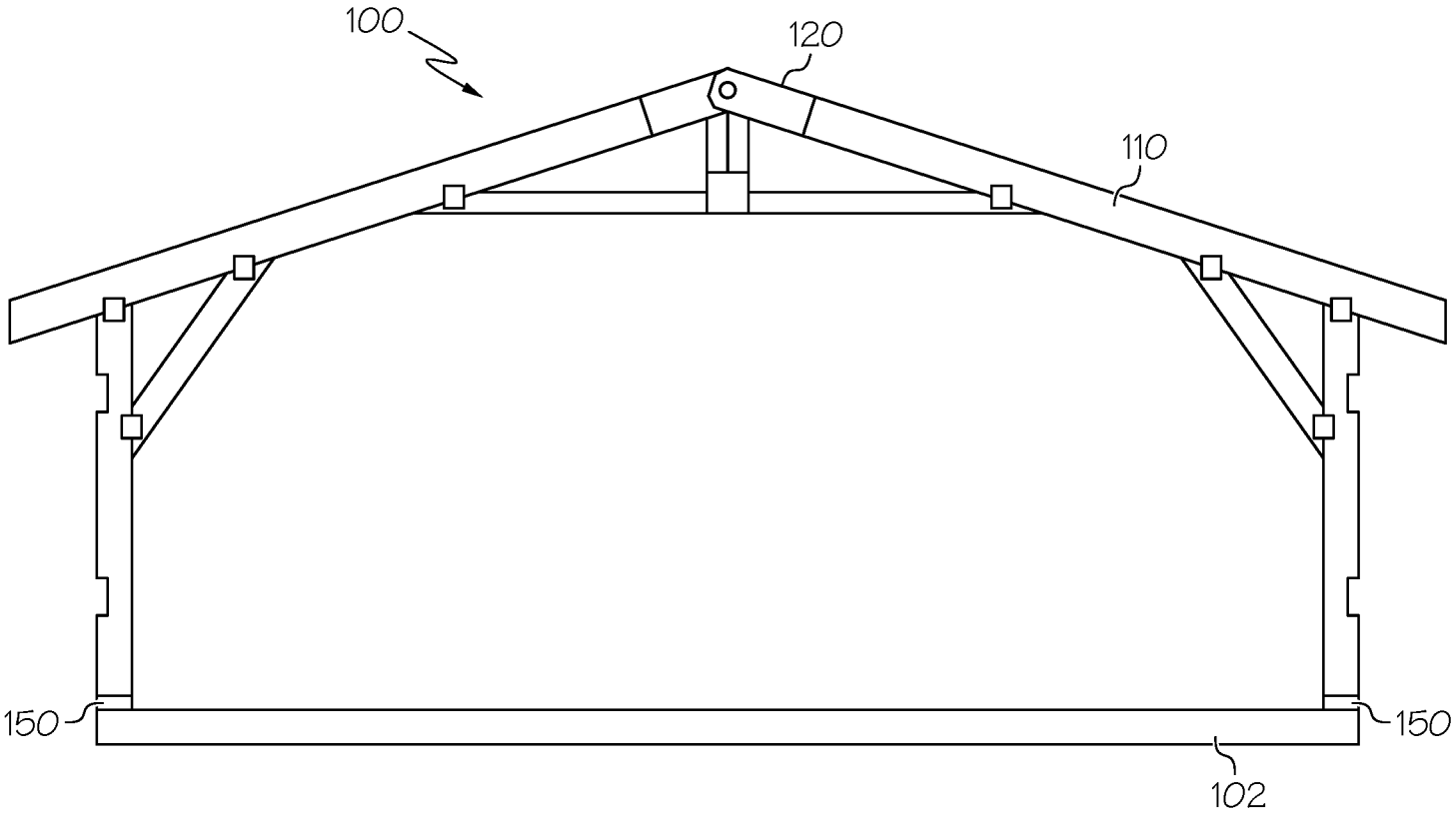
FIG. 13 illustrates an end view of a portion of a truss-wall stud installation system in accordance with one or more embodiments.
Figure 14:
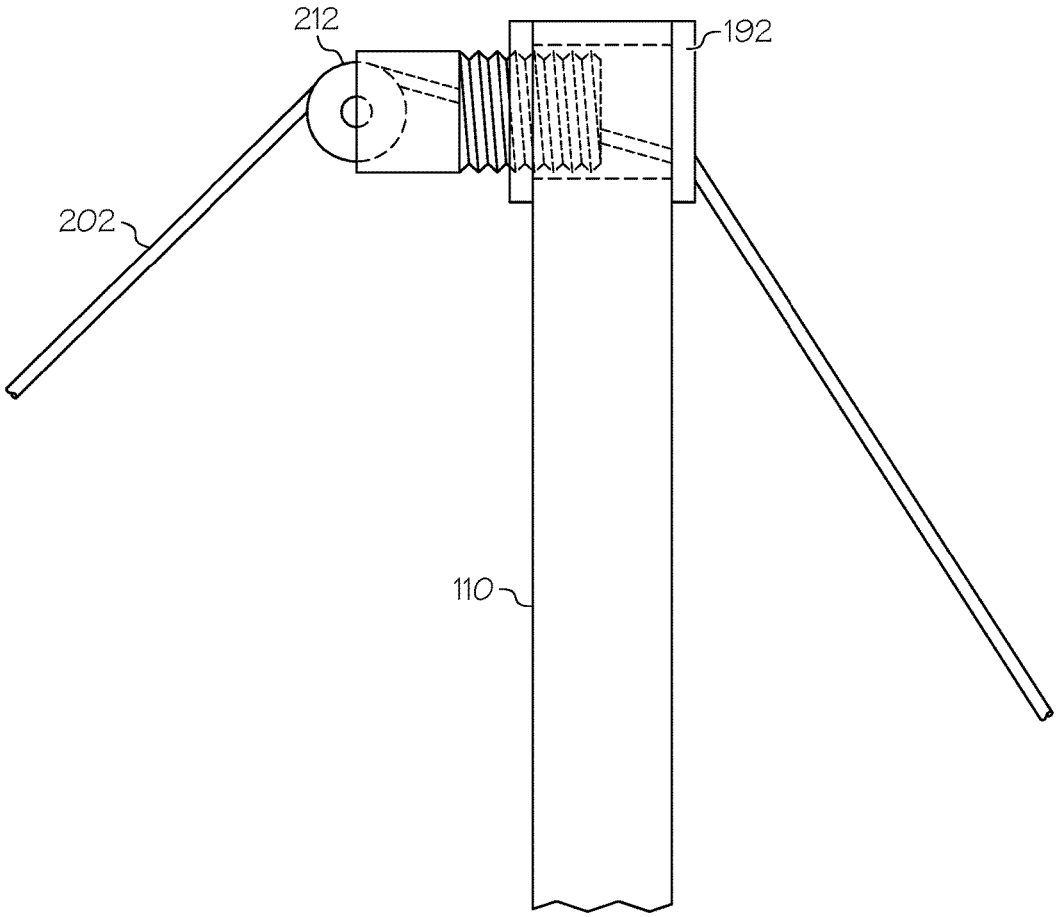
FIG. 14 illustrates a side view of a pulley of a truss-wall stud installation system in accordance with one or more embodiments.
Figure 15:
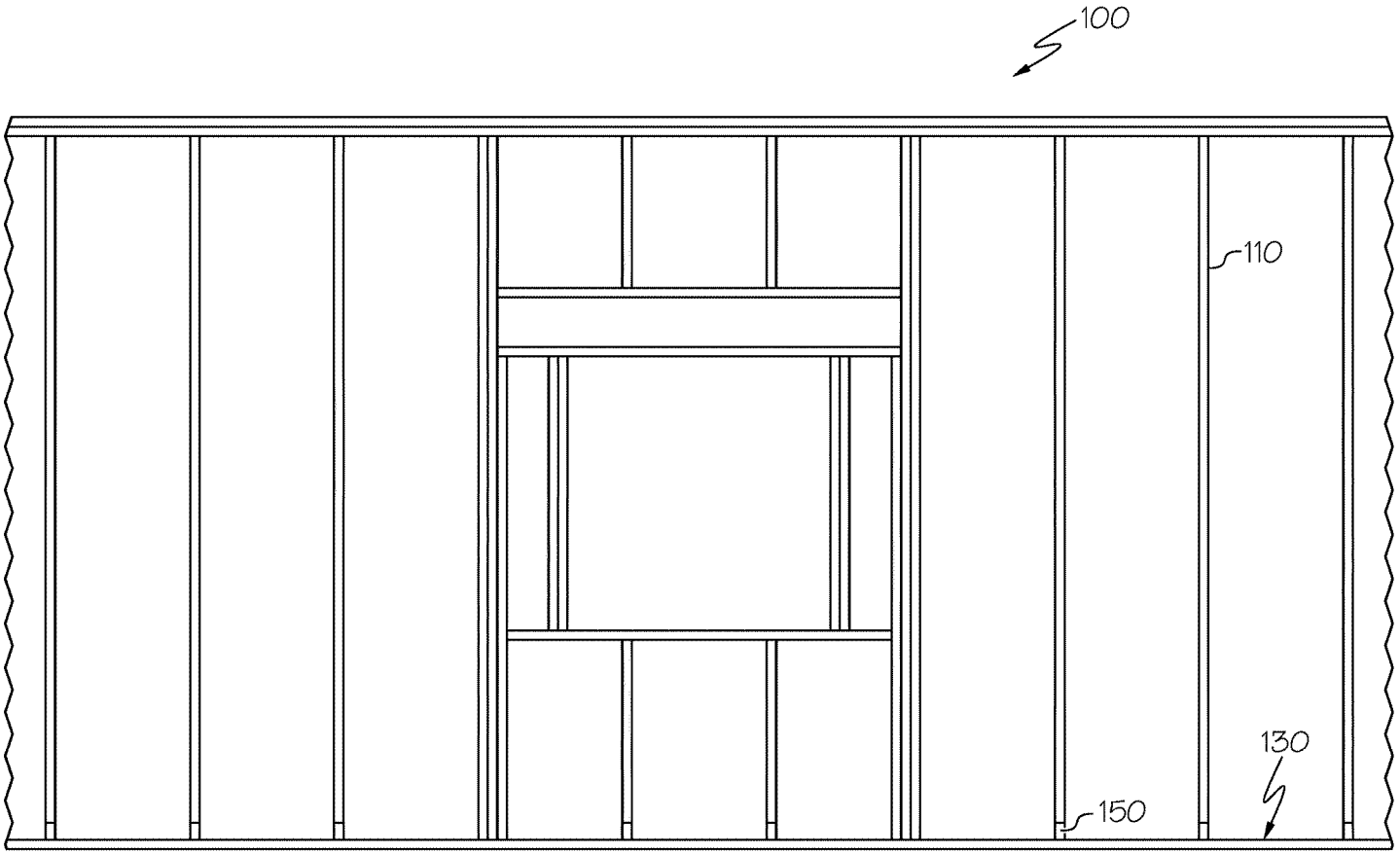
FIG. 15 illustrates a side view of a portion of a truss-wall stud installation system in accordance with one or more embodiments.
Figure 16:
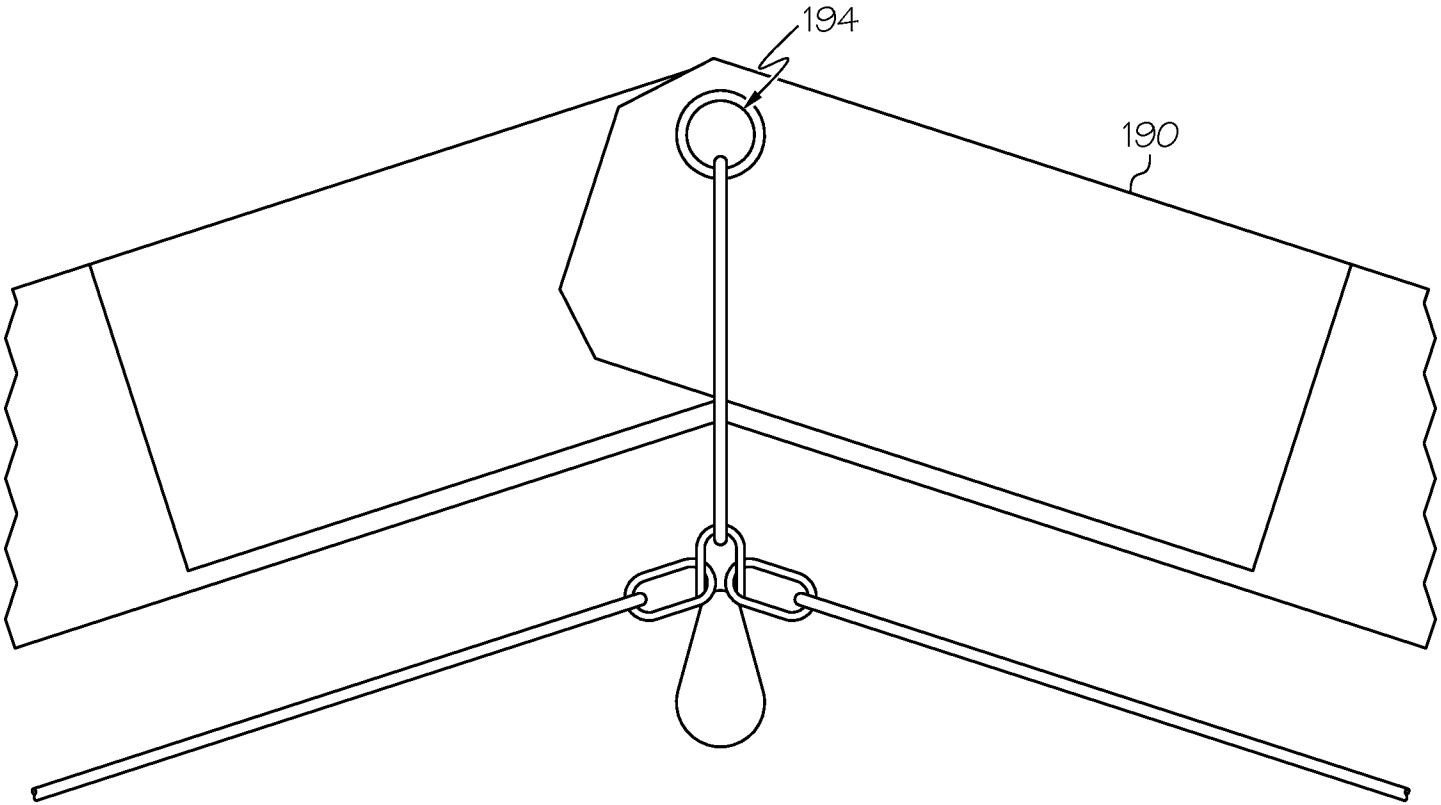
FIG. 16 illustrates a side view of a cable system of a truss-wall stud installation system in accordance with one or more embodiments.

After the pulley is installed in the end wall, the end of the cable (which is hanging underneath the grommet on the ground) is attached to the three point weighted cable lifting device (FIGS. 12, 12A, 12B, and 16). For instance, two hooks, for example J shaped hooks, on the ends of the three-point weighted cable lifting device are then hooked under each of the eaves of the truss-wall stud unit as it lies on the ground (FIGS. 12, 12A, and 12B). A telescoping bracing bracket is clamped to the bottom chord and attached to a pivoting receiver on a support, such as a vehicle hitch. The device will end and pivot up as the truss-wall stud unit is hoisted into a vertical orientation.

The winch is retracted, for example using a remote controlled device, and hoisting the entire truss-wall stud unit, which is lifted, and steadily supported by the cable system. The end truss-wall stud unit is lifted towards a vertical orientation such that the bottom of the folding peak bracket 190 and the flat bottom chord bracket 194 can be installed, or alternatively bottom-chord splice bracket 250 and standard gusset plate 251. The end truss-wall stud unit is further lifted until positioned in the vertical orientation. Once in the vertical position, the first inner portion 152 of the end hinge bracket 151 is bent up and fastened against the stud leg, and the outside tab 156 is bent up and fastened to the stud, for instance, to the outside edge of the stud.

After the end hinge brackets are completely fastened to the stud, the end truss-wall stud unit is measured for plumb, for example through use of a laser leveling device or plumb bob on the foundation slab under the peak of the truss-wall stud unit. Once the unit is plumb, a telescoping bracing bracket 206 is secured, and temporary bracing members are affixed diagonally from the outside stud legs of the bottom plate. The temporary braces and the telescoping bracing bracket remains in place and clamped to the end wall bottom chord and braced against the stationary vehicle. The winch 204 is reversed to release the cable lifting device from the eaves and center of the end truss-wall stud unit and lowered back to hoist the next truss-wall stud unit.

Two or more partial truss-wall stud units 118 are placed together, such as truss-wall stud unit halves, and secured near the peak for example on a top side of the peak with folding peak brackets and fastened along the top side of the bottom chord with the flat bottom chord bracket 194. Alternatively, two or more partial truss-wall stud units 118 may be secured at the peak for example on a top side of the peak with a standard gusset plate 251 and fastened along the bottom chord with the bottom chord splice bracket 250

Figure 10:
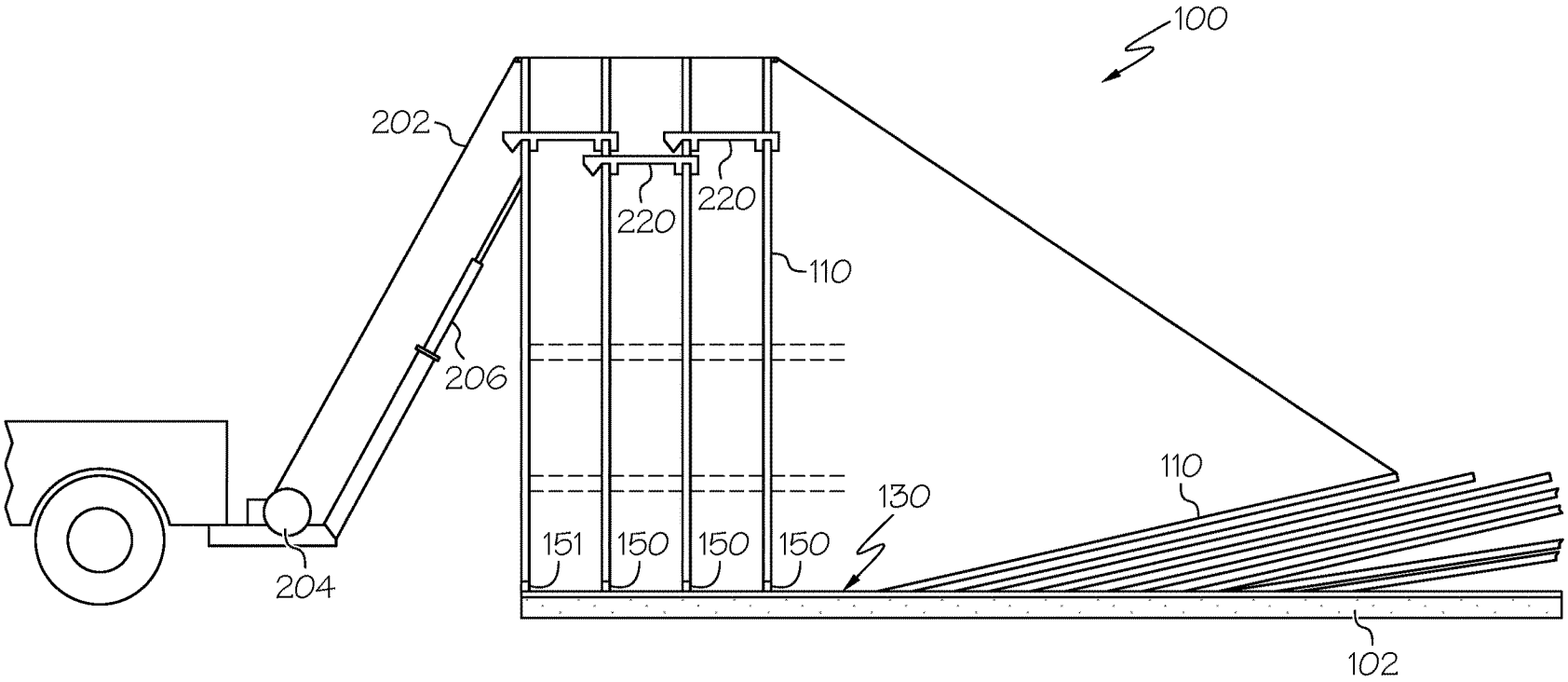
FIG. 10 illustrates a side view of the cable system, the telescoping bracing bar, and the truss-wall stud unit(s) of the truss-wall stud installation system in accordance with one or more embodiments.
Figure 11A:
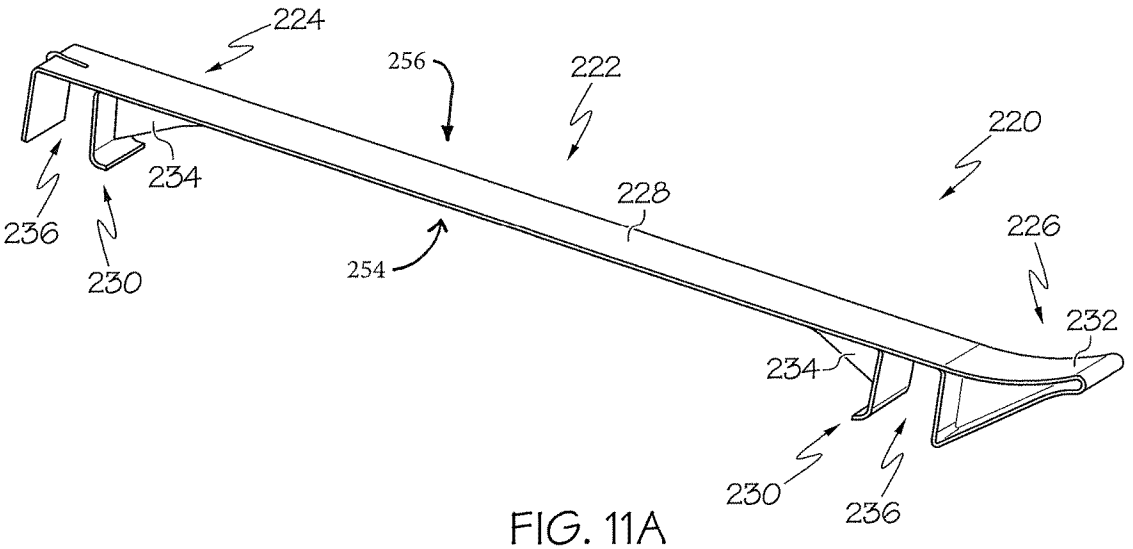
FIG. 11A illustrates a perspective view of a temporary interlocking spacer bar of a truss installation system in accordance with one or more embodiments.
Figure 11B:
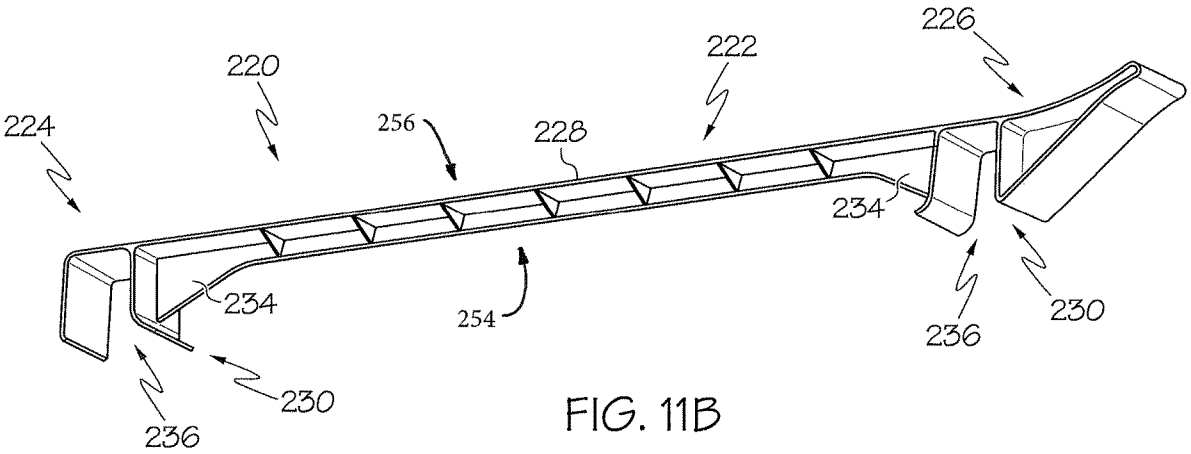
FIG. 11B illustrates a perspective view of a temporary interlocking spacer bar of a truss-wall stud installation system in accordance with one or more embodiments.
Figure 11C:
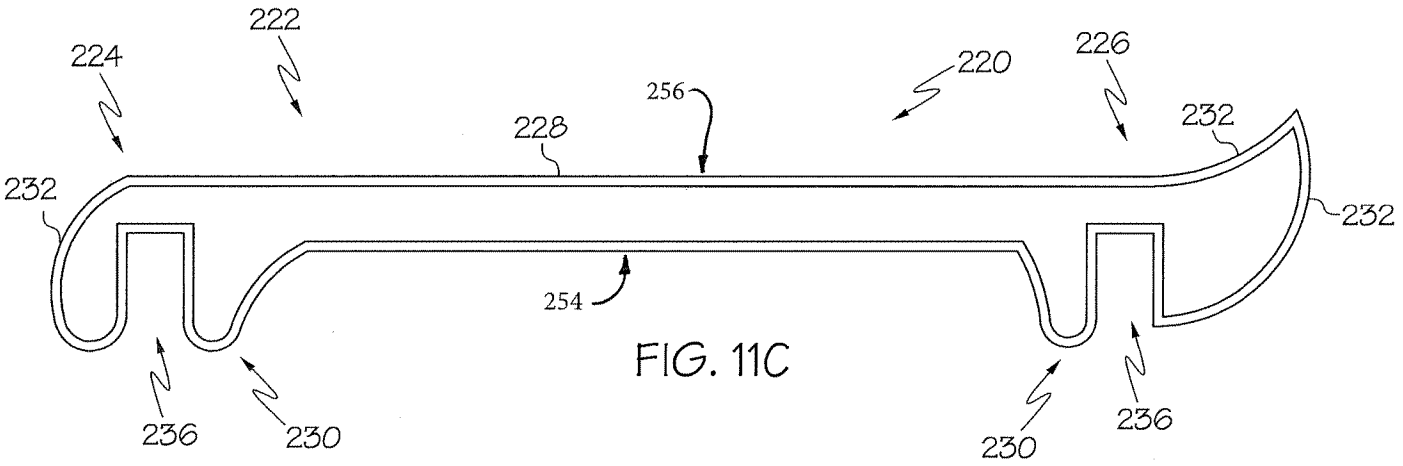
FIG. 11C illustrates a side view of a temporary interlocking spacer bar of a truss installation system in accordance with one or more embodiments.
Figure 11D:
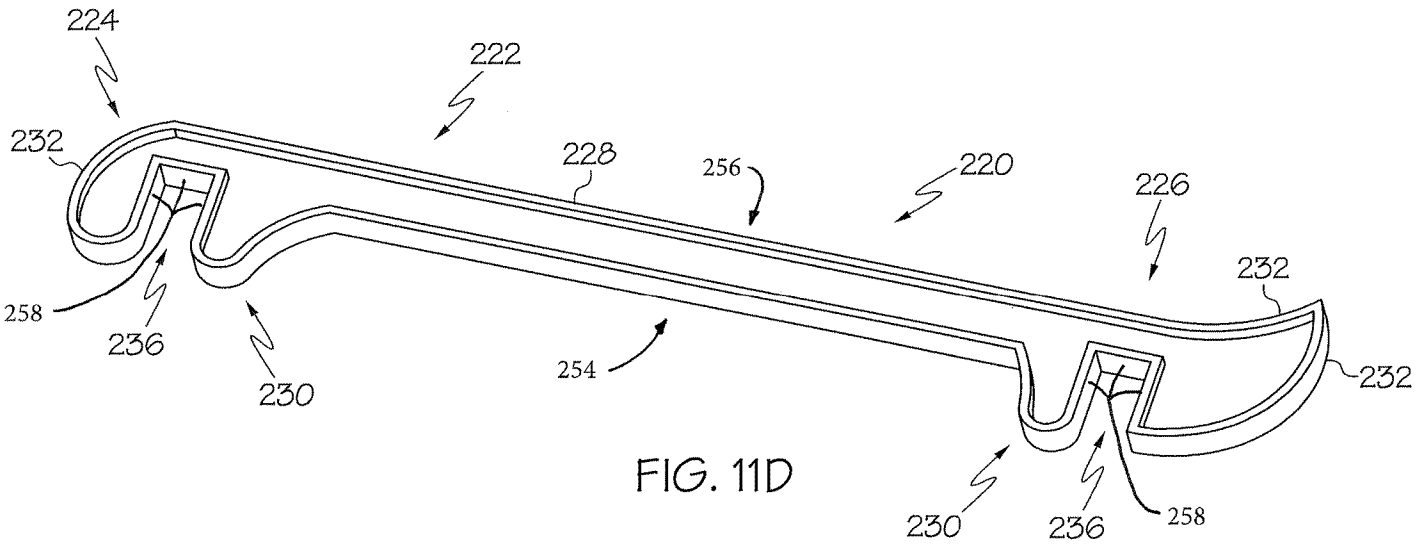
FIG. 11D illustrates a perspective view of a temporary interlocking spacer bar of a truss-wall stud installation system in accordance with one or more embodiments.

After affixing the first main portion 153A of the hinge bracket to the bottom plates, the bottom hinge bracket 150 are fastened to the truss-wall stud unit legs by bending the intermediate portion 158 and the first inner portion 152 of the hinge bracket up over the stud and fastening thereto. One or more temporary interlocking spacer bars 220 are fastened to a top member of the truss-wall stud unit, for example on each side of the peak of the truss-wall stud unit, approximately 3-5 feet from the peak, as shown in FIG. 10.

After the temporary interlocking spacer bars are fastened, the cable is passed through the passage 192 and attached to the three point weighted cable device of the cable system. The weighted cable device is coupled with the truss-wall stud unit, for example by coupling J shaped hooks on ends of the three point weighted cable device under each of the eaves of the truss-wall stud unit as it lies on or near the foundation or ground (see FIGS. 12, 12A, and 12B). The winch is retracted, for example, using a remote controlled device, and the truss-wall stud unit 110 is lifted toward the vertical orientation.

The truss-wall stud unit is hoisted about 5-6 feet and paused, enabling fasteners to be affixed to the bottom side of the folding peak bracket and flat bottom chord bracket. The truss-wall stud unit is then hoisted into vertical position. As it is hoisted, the temporary interlocking spacer bars 220 ride over the top of the previous truss-wall stud unit until they slip securely into place onto the previous truss-wall stud unit.

Once the truss-wall stud unit is in the vertical position, the second inner portion 154 of the hinge bracket 150 is bent up and fastened against the stud leg of the truss-wall stud unit, and the outer tab 156 is bent up and fastened to the outside edge of the stud. The winch is reversed, releasing the weighted cable lifting device from the peak and eaves of the truss-wall stud unit, and lowered back to the ground to hoist the next truss-wall stud unit 110. The process is repeated for subsequent truss-wall stud units until the final end wall is set.

Once a sufficient number of truss-wall stud units are set, for example 14-16 linear feet of truss-wall stud units, 2×4 lateral bracing is installed and fastened into optional pre-cut notches in the wall studs. After the lateral bracing is installed, the braced part of the structure can be sheeted with plywood in order to increase lateral shear strength. The process is repeated for every 16 linear feet until the entire perimeter of the structure is laterally braced and sheeted.

The above Detailed Description is intended to be illustrative, and not restrictive. The various embodiments are not necessarily mutually exclusive, as some embodiments can be combined with one or more other embodiments to form new embodiments. For example, the above-described embodiments (and/or aspects thereof) embodiments may be combined, utilized and derived therefrom, such that structural and logical substitutions and changes may be made without departing from the scope of this disclosure. Such embodiments of the inventive subject matter may be referred to herein, individually and/or collectively, by the term "invention" merely for convenience and without intending to voluntarily limit the scope of this application to any single invention or inventive concept if more than one is in fact disclosed. Many other embodiments will be apparent to those of skill in the art upon reviewing the above description. The scope of the invention should, therefore, be determined with reference to the appended claims, along with the full scope of equivalents to which such claims are entitled.

The methods described herein do not have to be executed in the order described, or in any particular order, unless it is otherwise specified that a particular order is required. Moreover, unless otherwise specified, various activities described with respect to the methods identified herein can be executed in repetitive, simultaneous, serial, or parallel fashion.

terms "a" or "an" are used, as is common in patent documents, to include one or more than one. The term "or" is used to refer to a nonexclusive or, unless otherwise indicated. In the appended claims, the terms "including" and "in which" are used as the plain-English equivalents of the respective terms "comprising" and "wherein." Also, in the following claims, the terms "including" and "comprising" are open-ended, that is, a system, device, article, or process that includes elements in addition to those listed after such a term in a claim are still deemed to fall within the scope of that claim. Moreover, in the following claims, the terms "first," "second," and "third," etc. are used merely as labels, and are not intended to impose numerical requirements on their objects.

The invention claimed is:

1. A temporary interlocking spacer bar comprising;

an elongate member having a first end portion, a second end portion and an intermediate portion disposed between the first end portion and the second end portion;

the first end portion having a first retention member, and the second end portion having a second retention member, wherein each of said first retention member and said second retention member is a recess sized and disposed on a first side of said spacer bar to receive a truss-wall stud; and the intermediate portion having a length to space two or more truss-wall stud units a predetermined distance from one another; and said first end portion including a first outer curved, portion disposed opposite said intermediate portion relative to said first retention member, said first outer curved portion being a convex curve extending from said first side in a direction toward a second side of said spacer bar, wherein said first side is opposite said second side, and wherein said first outer curved portion is configured to ride over a portion of an adjacent truss-wall stud prior to said adjacent truss-wall stud being received into said first retention member;

said first end portion including a second outer curved portion, said second outer curved portion being curved in the same direction as said first outer curved o f second outer curved portion extending from said second side in a direction away from said first side, and wherein said first outer curved portion and said second outer curved portion intersect at a common termination point.

2. The temporary interlocking spacer bar as recited in claim 1, wherein the temporary interlocking spacer bar is constructed from at least one of plastic, or metal.

3. The temporary interlocking spacer bar as recited in claim 1, further comprising rib supports disposed near at least one of the first end portion and the second end portion.

4. The temporary interlocking spacer bar as recited in claim 1, wherein the retention member comprises a U-shaped recess in said first side.

5. The temporary interlocking spacer bar of claim 1, wherein the temporary interlocking spacer bar is configured for assisting in securing the two or more truss-wall stud units.

6. The temporary interlocking spacer bar as recited in claim 1, wherein said recess of each of said first retention member and said second retention meniber is defined by two or more sidewalls.

7. A temporary interlocking spacer bar comprising:

a first end portion, a second end portion, and an intermediate portion disposed between said first end portion and said second end portion;

said first end portion having a first retention member disposed on a first side of said spacer bar, and a first outer curved portion disposed opposite said intermediate portion relative to said first retention member, and said first outer curved portion curving and extending from said first side in a direction toward a second side of said space bar and opposite the retention member, wherein said second side is opposite said first side, and wherein said first end portion includes a second outer curved portion, said second outer curved portion being curved in the same direction as said first outer curved portion, said second outer curved portion extending from said second side in a direction away from said first side, and wherein said first outer curved portion and said second outer curved portion intersect at a common termination point;

said second end portion having a second retention member and a third outer curved portion opposite said intermediate portion relative to said second retention member;

said intermediate portion including an elongate member extending between and integrally connected to the first and the second end portions; and one or more rib supports disposed at the transition between the intermediate portion and the first end portion and one or more rib supports disposed at the transition between the intermediate portion and the second end portion;

wherein each of the first retention member and the second retention member comprise a recess for receiving and retaining a truss member therein;

wherein said intermediate portion has a length to space two truss members in a truss-wall a predetermined distance from one another; and said first outer curved portion is configured to ride over a portion of an adjacent truss member prior to said adjacent truss member being received into said first retention member.

8. A temporary interlocking spacer bar comprising:

a first end portion, a second end portion and an intermediate portion between said first end portion and said second end portion;

a first side and a second side said first side opposite said second side;

said first end portion having a retention member comprising a first recess disposed on the first side and configured to receive a member of a first truss, said first recess having an open end on said first side of said spacer bar, and said first end portion having a first outer curved portion, said first outer curved portion disposed opposite said intermediate portion relative to said first recess and said first outer curved portion curving and extending from first side in a direction toward said second side;

said first end portion including a second outer curved portion, said second outer curved portion being curved in the same direction as said first outer curved portion, said second outer curved portion extending from said second side in a direction away from said first side, and wherein said first outer curved portion and said second outer curved portion intersect at a common termination point;

a second end portion having a retention member comprising a second recess disposed on said first side and configured to receive a member of a second truss, said recess having an open end on said first side of said spacer bar;

said intermediate portion having a length to space two truss members in a truss-wall a predetermined distance from one another;

said first recess defined by a plurality of sidewalls; and said second recess defined by a plurality of sidewalls; and wherein said first outer curved portion is configured to ride over said member of said first truss prior to said member of said irst truss being received into said first recess.

9. The temporary interlocking spacer bar of claim 8, wherein said first and second recess each have a U-shape defined by three sidewalls.

* * * * *